US009327205B2

(12) United States Patent
Gongolas

(10) Patent No.: US 9,327,205 B2
(45) Date of Patent: May 3, 2016

(54) KINETIC ENTERTAINMENT DEVICE, KIT AND METHOD FOR MANUFACTURING THE SAME

(71) Applicant: Christopher Gongolas, Houston, TX (US)

(72) Inventor: Christopher Gongolas, Houston, TX (US)

( * ) Notice: Subject to any disclaimer, the term of this patent is extended or adjusted under 35 U.S.C. 154(b) by 226 days.

(21) Appl. No.: 13/840,073

(22) Filed: Mar. 15, 2013

(65) Prior Publication Data

US 2014/0273732 A1 Sep. 18, 2014

(51) Int. Cl.
*A63H 33/00* (2006.01)
*A63H 33/40* (2006.01)

(52) U.S. Cl.
CPC ..... *A63H 33/00* (2013.01); *A63H 33/40* (2013.01); *Y10T 29/49826* (2015.01)

(58) Field of Classification Search
USPC ..... 446/2, 3, 71, 168, 170, 487, 488, 490, 446/491; 434/276, 300, 302; 482/124
See application file for complete search history.

(56) References Cited

U.S. PATENT DOCUMENTS

| | | | | | |
|---|---|---|---|---|---|
| 2,415,012 | A | | 1/1947 | James | |
| 2,500,253 | A | * | 3/1950 | Kimple | 446/236 |
| 2,622,366 | A | * | 12/1952 | Abplanalp | 446/139 |
| 2,854,786 | A | * | 10/1958 | Sabo | 446/486 |
| 3,047,980 | A | * | 8/1962 | Bischoff | 446/486 |
| 3,516,193 | A | * | 6/1970 | Engelman | 446/486 |
| 3,609,606 | A | * | 9/1971 | Podesto | 335/209 |
| 3,688,415 | A | * | 9/1972 | Stehl | 434/302 |
| 3,703,292 | A | * | 11/1972 | Starr | 273/330 |
| 4,114,306 | A | | 9/1978 | Molenaar | |
| 4,595,369 | A | * | 6/1986 | Downs | 434/302 |
| 5,005,828 | A | | 4/1991 | Sauerbrey | |
| 5,134,597 | A | * | 7/1992 | Bradt | 368/223 |
| 5,490,826 | A | * | 2/1996 | Rose | 482/74 |
| 5,626,505 | A | * | 5/1997 | Cheng | 446/278 |
| D382,029 | S | * | 8/1997 | Hong Cheng | D21/611 |
| 5,683,336 | A | * | 11/1997 | Pape | 482/124 |
| 5,692,737 | A | * | 12/1997 | Perlsweig | 267/168 |
| 5,727,984 | A | | 3/1998 | Lin | |
| 5,975,911 | A | * | 11/1999 | Tuck | 434/300 |
| 6,000,991 | A | * | 12/1999 | Truchsess et al. | 446/397 |
| 6,287,242 | B1 | * | 9/2001 | Fray | 482/121 |
| 6,361,395 | B1 | | 3/2002 | Pacza | |
| 6,364,614 | B1 | | 4/2002 | Mnatsakanian | |
| 6,554,684 | B2 | | 4/2003 | Marlin | |
| 7,004,892 | B2 | * | 2/2006 | Marco | 482/124 |
| 7,021,808 | B2 | * | 4/2006 | Currie et al. | 362/551 |
| 7,101,249 | B2 | | 9/2006 | Forti et al. | |
| 7,140,945 | B2 | * | 11/2006 | Dinhofer | 446/378 |
| 7,415,012 | B1 | | 8/2008 | Mankins | |
| 7,718,241 | B2 | | 5/2010 | Wittmeyer, Jr. | |
| 7,744,511 | B2 | * | 6/2010 | Grigoriev et al. | 482/124 |
| 7,850,583 | B2 | * | 12/2010 | Smith | 482/124 |
| 8,109,804 | B2 | * | 2/2012 | Su | 446/131 |
| 8,915,827 | B2 | * | 12/2014 | Cranke et al. | 482/121 |
| 2002/0094753 | A1 | | 7/2002 | Campos et al. | |
| 2002/0197933 | A1 | | 12/2002 | Shea | |

OTHER PUBLICATIONS

International Search Report and Written Opinion Issued for Application No. PCT/US14/28056, dated Sep. 16, 2014.

* cited by examiner

*Primary Examiner* — Kurt Fernstrom

(57) ABSTRACT

A kinetic entertainment device comprises one or more elongated flexible strips anchored to a surface either directly or via a base. As a result, the strip can be modified into a desired static shape and, upon excitation, a corresponding kinetic (i.e., motion) shape.

58 Claims, 9 Drawing Sheets

FIG. 2C
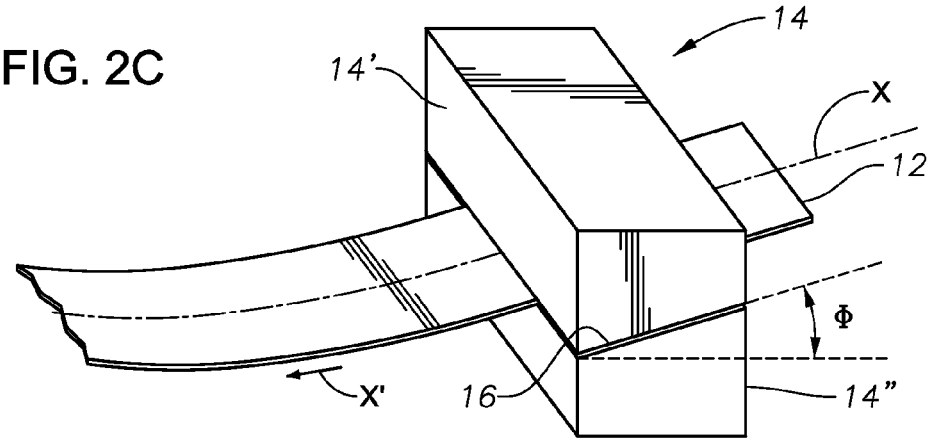
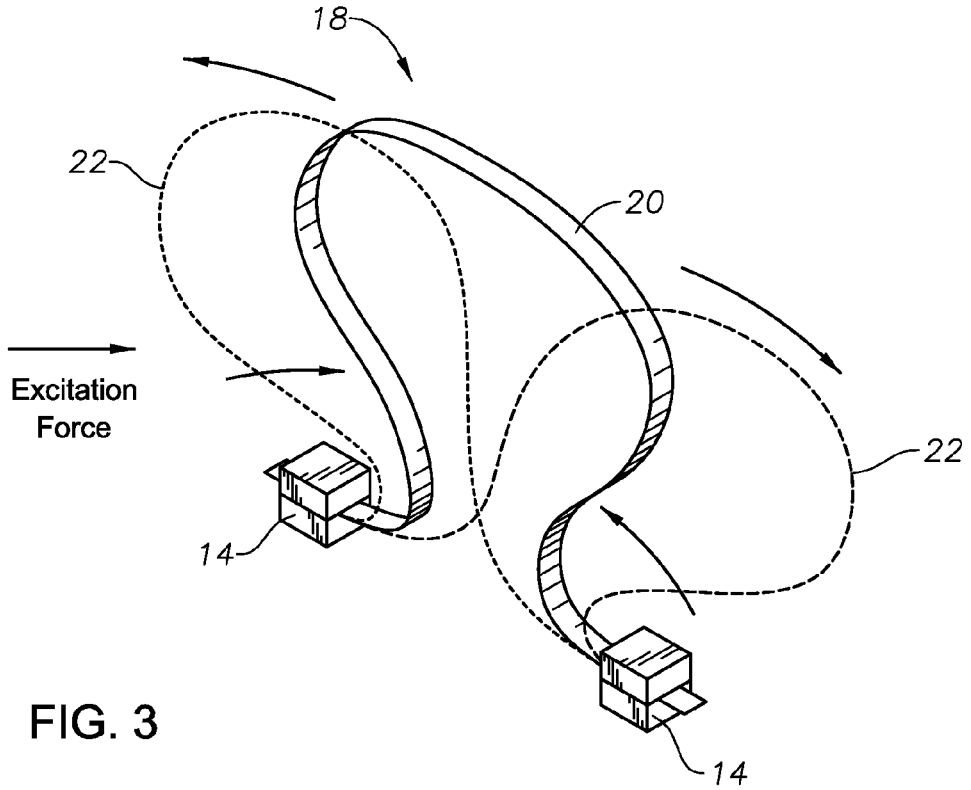
FIG. 3

KINETIC ENTERTAINMENT DEVICE, KIT AND METHOD FOR MANUFACTURING THE SAME

FIELD OF THE INVENTION

The present invention generally relates to an entertainment device and/or kit and, more specifically, to a kinetic entertainment device that can be configured into a variety of kinetic (i.e., motion) shapes once excited into movement.

BRIEF DESCRIPTION OF THE DRAWINGS

FIG. 2C illustrates an exploded view of a base and strip connection according to an exemplary embodiment of the present invention;

FIG. 3 illustrates a perspective view of the static and kinetic shape of an assembled kinetic entertainment device according to an exemplary embodiment of the present invention;

SUMMARY OF THE INVENTION

Exemplary embodiments of the present invention provide a kinetic kit and/or entertainment device comprising one or more strips of flat, elongated, flexible material attached to a surface either directly or via one or more bases. By manipulating the positioning of the strips and/or the bases, among other described features, the strips can be manipulated into a variety of static configurations, such as loops or twists. The static configurations each have a corresponding kinetic shape (or moving shape) that is affected after the strip has been excited into movement using physical, atmospheric, or other means.

DESCRIPTION OF ILLUSTRATIVE EMBODIMENTS

Illustrative embodiments and related methodologies of the present invention are described below as they might be employed in a kinetic entertainment kit and device, as well as a method for manufacturing the same. In the interest of clarity, not all features of an actual implementation or methodology are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methodologies of the invention will become apparent from consideration of the following description and drawings. As used herein and illustrated in the figures, persons of skill in the art will understand that "elongated" means the strip is defined along a substantially straight axis X extending between the first and second ends. In this regard, the edges of the strip extent in a substantially parallel direction X' to the straight axis X along the length of the strip. Likewise, as used herein and illustrated in the figures, "flexible" means the strip is elastically deformable so as to be primarily bendable between the two ends about the width of the strip.

Figure 1A:
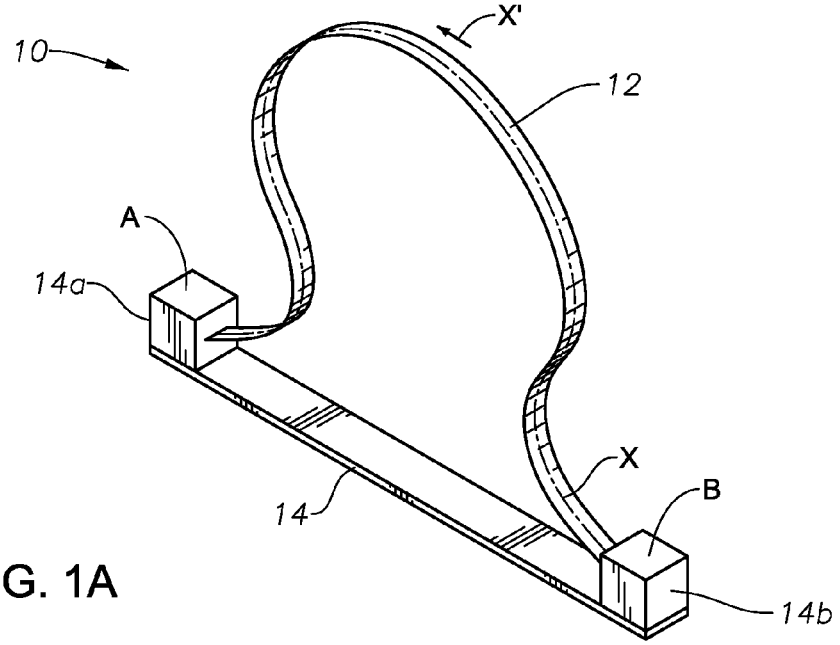
FIG. 1A illustrates a perspective view of a kinetic entertainment device having two bases according to an exemplary embodiment of the present invention.

FIG. 1A illustrates a kinetic device 10 according to an exemplary embodiment of the present invention. Kinetic device 10 includes a strip 12 of material and a base 14 on which to attach strip 12. In this embodiment, strip 12 is made of a strip or sheet of flat, elongated, flexible, and springy material such as steel, aluminum, exotic metal alloy, polymers, titanium, carbon fiber, or fiber glass composited polymeric material. As would be understood by ordinarily skilled persons in the art having the benefit of this disclosure, strip 12 is sufficiently sized, relative to the base, to take advantage of the selected material's combination of modulus of elasticity, tensile strength, stiffness and, hence, its springiness. In addition, the material of strip 12 in certain embodiments will not retain coil memory or permanently deform when stored for long periods of time in a coiled up or reduced size.

Base 14 is an elongated base having a first portion 14*a* and second portion 14*b* that will be connected to strip 12 at points A and B as illustrated. Base 14, and the other bases described herein, can be made from a variety of materials such as, for example, concrete, wood, steel, rubber, polyurethane, reusable putty, plastic, composite, etc. In the alternative, however, strip 12 may be placed directly on a horizontal, angular, or vertical surface instead of base 14, and secured thereto in any desired way, as would be understood by one ordinarily skilled in the art having the benefit of this disclosure. The foregoing base and strip may be provided in the form of a kit having assembly instructions and a variety of stripes with different characteristics, such as, for example, dimensions or materials of manufacture, that will result in different kinetic responses.

Figure 1B:
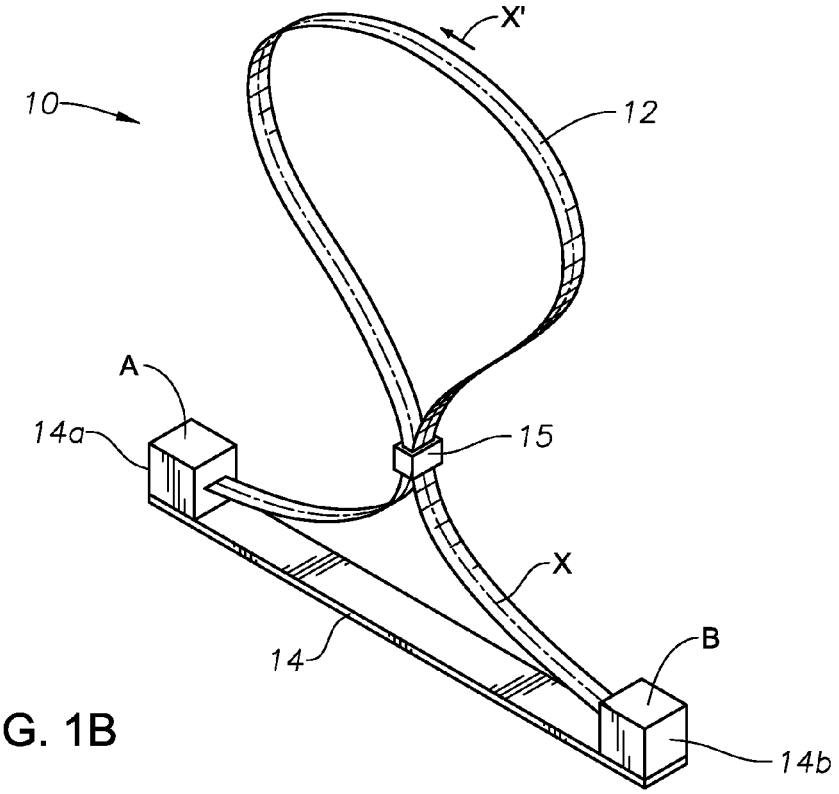
FIG. 1B illustrates a perspective view of a kinetic entertainment device having an adjustable collar according to an exemplary embodiment of the present invention.

Referring to FIG. 1B, an alternative embodiment of kinetic device 10 is illustrated in which a collar 15 is positioned around strip 12. The position of collar 15 relative to the ends of strip 12 can be adjusted to alter the kinetic response of strip 12. Strip 12 may be configured in a variety of static (i.e., stationary) configurations that each has its own kinetic (i.e., motion) shape. For example, such shapes may include balloons, loops, or circular shapes. As illustrated in FIGS. 1A & B, the static configuration of strip 12 is a circular shape. The ends of strip 12 may also be positioned inside bases 14*a,b* at varying angles, thereby inducing different static and corresponding kinetic shapes.

Once assembled, strip 12 may be excited into movement in a variety of ways such as, for example, by hand, breath, ambient atmospheric wind, vibration, or by other mechanical means. Once excited, strip 12 will have a rebounding, resonating, or wobbling kinetic shape that sways side-to-side in a variety of complex or simple curvilinear shapes. However, although moving, the kinetic shape of strip 12 will remain substantially the same. As such, the kinetic shape of strip 12 will also be a circular spiral shape.

Figure 2A:
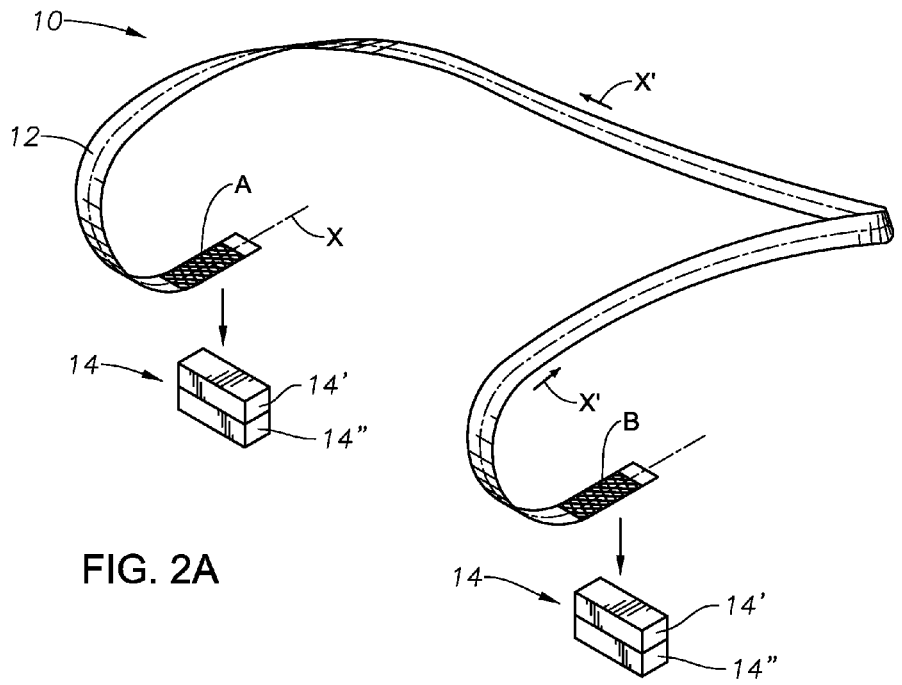
FIG. 2A illustrates a perspective view of a kinetic entertainment device according to an alternate exemplary embodiment of the present invention.
Figure 2B:
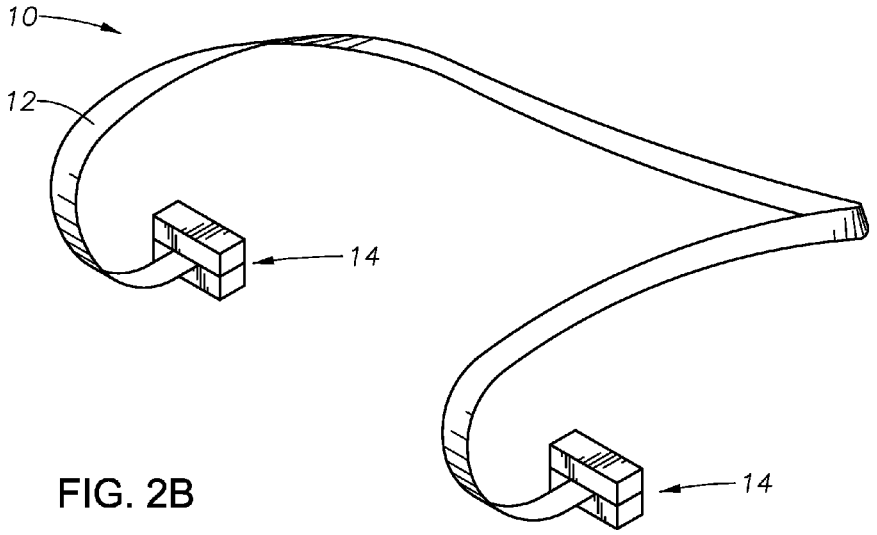
FIG. 2B illustrates a perspective view of a kinetic entertainment device according to an alternate exemplary embodiment of the present invention.

FIGS. 2A & 2B illustrate another kinetic device 10 according to an exemplary embodiment of the present invention. Here, strip 12 is a flat, elongated, flexible, sheet or strip of material that may be manipulated into a variety of a static configurations that each has a corresponding kinetic shape. However, in this embodiment, bases 14 are two individual cube-type bases. In certain embodiments, bases 14 may have upper and lower portions 14', 14", respectively, that define one or more attachment points. Alternatively, bases 14 may simply have one or more slots that define attachment points, the slots disposed in one or more cube faces, where the slots are disposed for receipt of an end of strip 12. During assembly of device 10, one base 14 is attached to portion A of one end of strip 12, while the other base 14 is attached to portion B of the opposite end of strip 12, whereby portions A and B are placed between upper and lower portions 14', 14" as previously described. In alternative embodiments, attachment points on bases 14 may comprise hook and loop fasteners, snaps, suction cups or other mechanisms to secure a strip 12 portion or end to a base. In another alternative embodiment, two or more strips 12 may be attached to the bases 14.

With reference to FIGS. 1A-2B, the distance between bases 14 affects the static shape of strip 12. Upon assembly of device 10, the distance between bases 14 would be less than the length of strip 12. As would be understood by ordinarily skilled persons having the benefit of this disclosure, the closer bases 14 are together, the more "saggy" or "droopy" the static and kinetic shape of strip 12. The farther apart bases 14 are positioned, the tighter the static and kinetic shapes would be.

As shown in FIG. 2C, the angular intersection 16 of upper and lower portions 14', 14" of base 14 may be altered in order to effect different static and kinetic shapes of strip 12. Here, intersection 16 has been angled at an angle Φ. Those ordinarily skilled in the art having the benefit of this disclosure realize there are a variety of angles which could be utilized, and that differing angles could be used to attach portions A and B. However, in the alternative, strip 12 may also be placed directly on a surface without the use of bases 14.

Once assembled, strip 12 is excited in motion by any variety of means, as previously described. Once excited, the static shape of strip 12 is then translated to its corresponding kinetic shape, which is maintained as strip 12 moves along any variety of axii. For example, strip 12 may move up and down, front to back, or side to side, in a wobbly, rebounding, or resonating pattern. As such, those ordinarily skilled in the art having the benefit of this disclosure realize there are a variety of shapes and movement patters that could be achieved using the present invention. A variety of ways in which to excite strip 12 were previously described.

In an alternate exemplary embodiment of the present invention, bases 14 may also be magnetic, thus allowing the assembled kinetic device to be placed in a vertical or horizontal position along a wall or other desired surface. Also, light emitting material, such as light emitting diodes may be attached to strip 12, or other reflective or effectual material may be added to strip 12, as will be described below. Similarly, strip 12 may be formed of or incorporate light transmitting material, such as, for example, fiber optics, and base 14 may be provided with or incorporate a light source for use in conjunction therewith.

In a further exemplary embodiment, a second strip 12 may also be coupled to bases 14. Accordingly, referring to FIG. 2B, a second strip 12 would be coupled to bases 14 in like manner to the illustrated strip 12. However, in the alternative, only one base 14 may be used to connect to a single strip 12, thereby affecting a unique static and kinetic shape. In yet another alternative embodiment, the ends of strip 12 can be secured to a single base having a spike which could be inserted directly into a surface. In an alternative embodiment, the base may be integrally formed with the strip, wherein the ends of strip 12 are shaped in the form of a spike. Those ordinarily skilled in the art having the benefit of this disclosure realize there are a variety of features disclosed herein that could be combined as desired.

As previously described, kinetic device 10 may be excited in a variety of ways, including mechanical, physical, or atmospheric (e.g., wind) means. Once excited, the static shape of strip 12 is translated into a kinetic shape that moves as a function of the static shape and the excitation force, as illustrated in the exemplary embodiment of FIG. 3. Here, assembled kinetic device 18 is illustrated in its static shape 20 and corresponding kinetic shape 22. A lateral excitation force has been applied to the strip of kinetic device 18, thus resulting in a side-to-side swaying of the strip. During excitation, however, kinetic shape 22 is maintained and corresponds to original static shape 20. Original static shape 20 is determined based upon a variety of factors including the flexibility of the strip, positioning/angle of bases 14, as well as the angular orientation of the surface upon which bases 14 are positioned.

Alternatively, the movement illustrated in FIG. 3 may also be described in terms of static and dynamic portions along strip 12. Here, for example, the portions of strip 12 adjacent bases 14 may be described as a first and second static portion, while the portion between the static portions is referred to as a dynamic portion. Therefore, during excitation, the first and second static portions will remain substantially static, while the dynamic portion extending therebetween will move as illustrated.

Figure 4A:
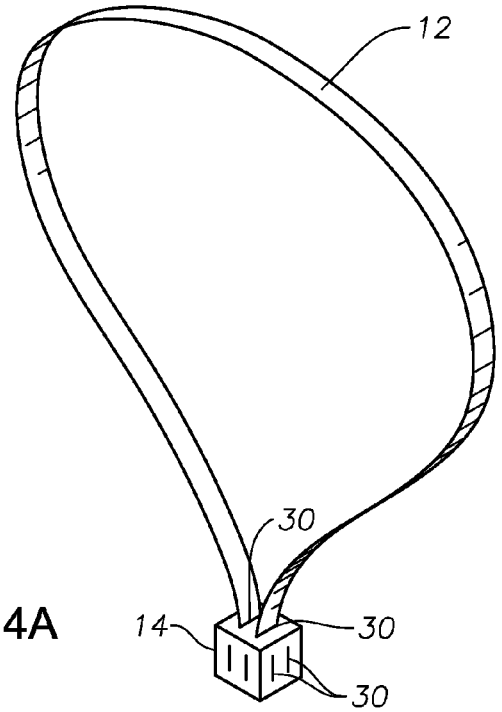
FIG. 4A illustrates a perspective view of a static shape of an assembled kinetic entertainment device in which a single base is utilized according to an exemplary embodiment of the present invention.
Figure 4B:
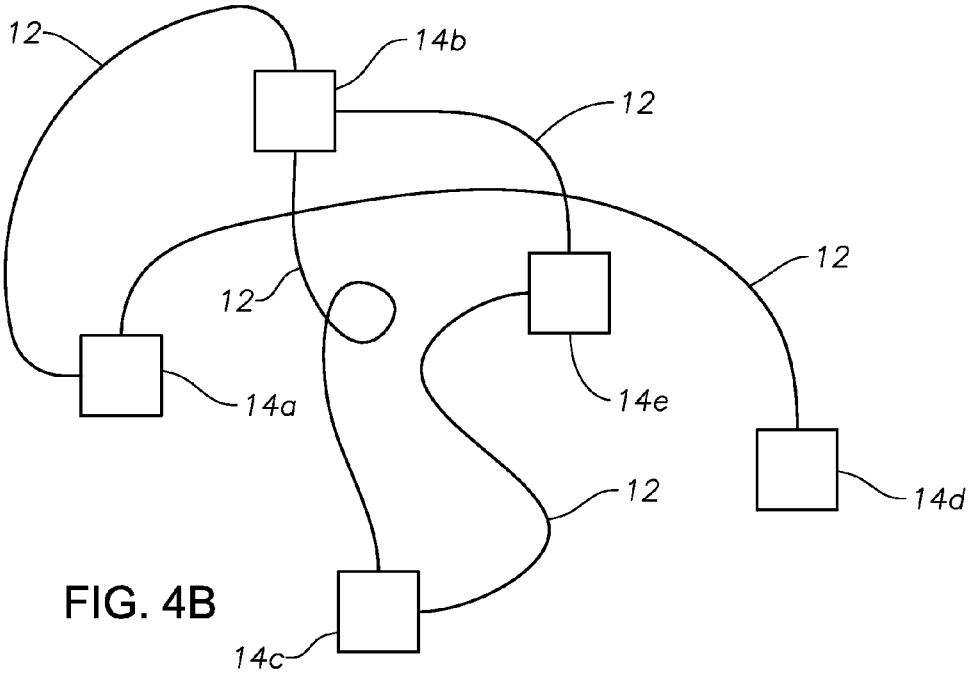
FIG. 4B illustrates a perspective view of the static shape of an assembled kinetic entertainment device whereby multiple strips and bases are utilized according to an exemplary embodiment of the present invention.

FIG. 4A illustrates yet another exemplary embodiment of the present invention whereby a single base 14 is utilized. Here, base 14 is a cube having one or more slots 30 positioned therein to receive strip 12. Slots 30 may be formed by molding, for example, and located on multiple faces of base 14 and/or oriented at different angles. In addition, two or more strips 12 may be simultaneously positioned inside slots 30 of base 14. Base 14 may be made of a variety of materials, such as, for example, rubber, silicone, elastomer, plastic or some other material. In one embodiment, base 14 is weighted by the material it is comprised of or otherwise provided with other weights, such as, for example, a metal core with a rubber or silicone coating to prevent slippage and removably secure strips 12. In addition, two or more bases 14 may be utilized as previously described herein. In those embodiments utilizing two or more bases 14, one base 14 may be positioned on a surface at an angle different from a second base 14, thereby affecting the resulting shape of strip(s) 12. In addition, one base 14 may be positioned on a surface, while the other base 14 is positioned in a user's hand or some other surface. Moreover, as shown in FIG. 4B, multiple strips 12 may be connected to multiple bases 14*a-e* to form a variety of playscapes.

Figure 5:
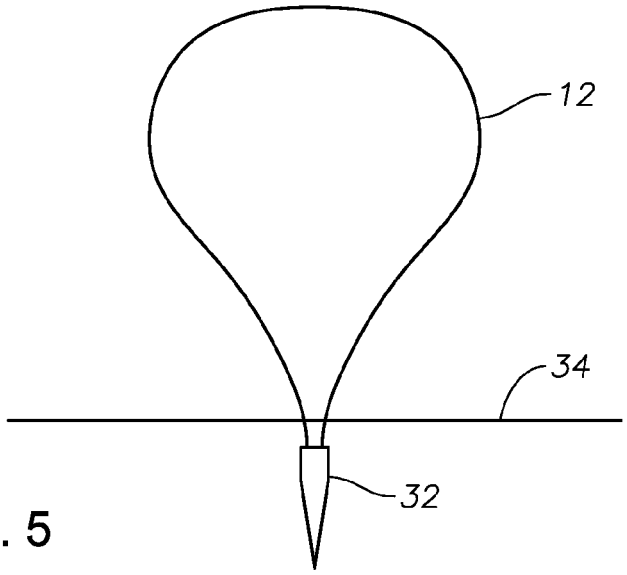
FIG. 5 illustrates a perspective view of the static shape of an assembled kinetic entertainment device utilizing a single strip and a spiked base according to an exemplary embodiment of the present invention.

FIG. 5 illustrates another exemplary embodiment of the present invention whereby strip 12 is attached to a spiked base 32 and inserted into surface 34. In an alternative embodiment, strip 12 itself may form the spiked base by molding the ends of strip 32 accordingly. Surface 34 may be, for example, the ground or some other surface.

Figure 6A:
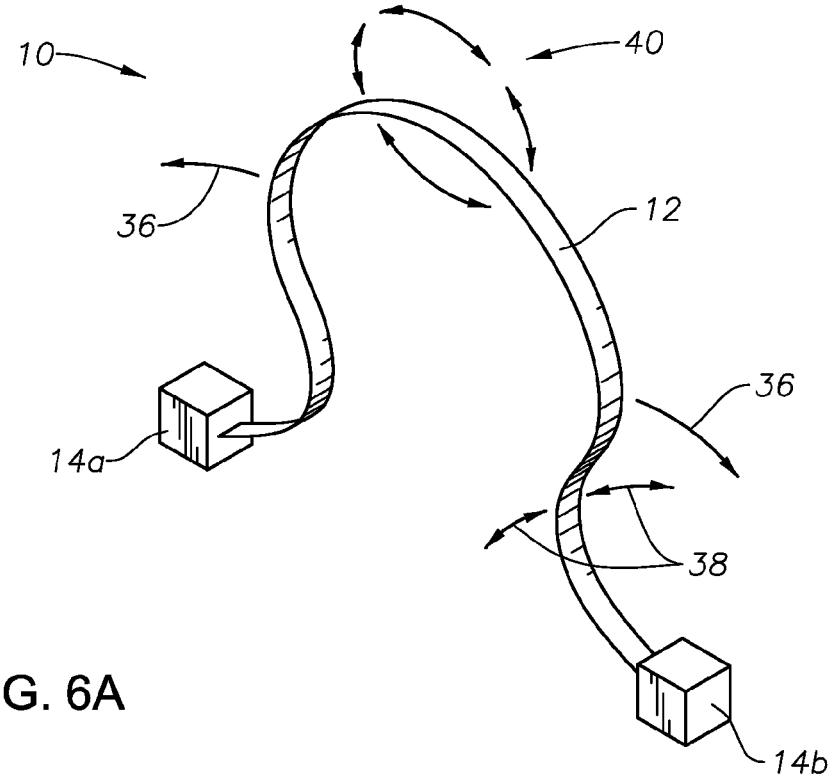
FIGS. 6A-6C illustrate various perspective views of static and kinetic shapes, and various excitation movements, according to certain exemplary embodiments of the present invention.

Referring to FIG. 6A, device 10 is illustrated to show various movements of strip 12 after excitation, according to certain exemplary embodiments of the present invention. Here, a single strip 12 is connected to bases 14 which may be any of the bases described herein, such as base 14*a* and base 14*b*. As previously described, strip 12 may be excited into movement using a variety of methods. For example, strip 12 may be excited in a left to right direction 36, a front to back direction 38, or a circular direction 40. Moreover, although shown utilizing on one strip 12, multiple strips 12 may be utilized having the same or varying lengths.

Figure 6B:
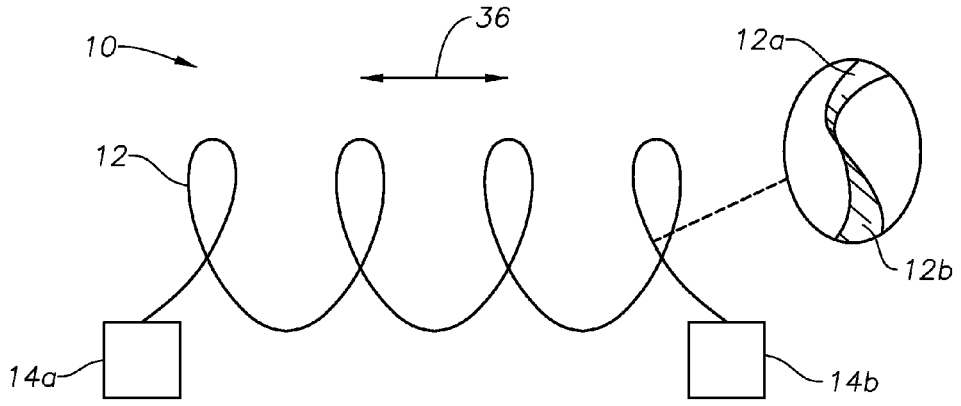
Figure 6C:
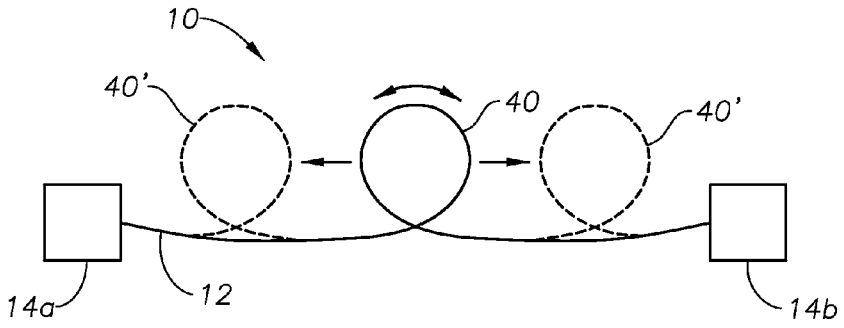

FIG. 6B illustrates yet another embodiment of device 10 whereby strip 12 has been twisted one or more times such that it has a spring-like static shape. A portion of strip 12 has been magnified to further illustrate the twisting of strip 12. In this regard, strip 12 has a surface 12 *a* and an opposite surface 12 *b*. In one exemplary embodiment, a single twist orients the surfaces 12 *a,b* so that the surfaces 12 *a* or 12 *b* face the same direction when bases 14 *a,b* are positioned on a surface. Alternatively, any number of twists may be utilized. Nevertheless, once strip 12 is excited into movement (left to right, for example), strip 12 will begin to compress in a left to right direction 36, akin to the movement of a caterpillar. Lastly, in FIG. 6C, strip 12 has been twisted into a static shape resembling a single loop 40. In this example, loop 40 is then excited into a left to right direction 36 once again. As a result, loop 40 begins to roll back and forth along strip 12 (40') in a left to right motion, akin to a wheel rolling along a surface. Therefore, as will be understood by those ordinarily skilled in the art, there are a variety of such static and kinetic shapes that are achievable utilizing the present invention.

Figure 7C:
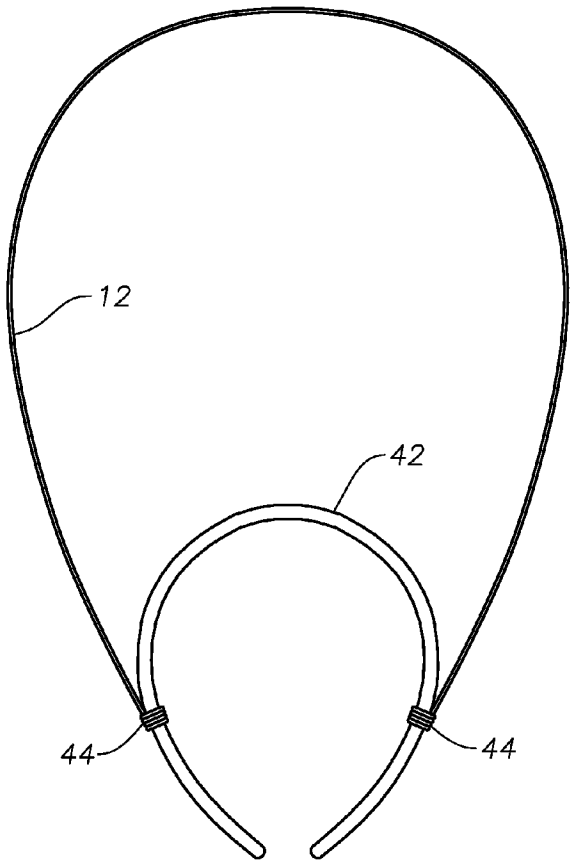
FIGS. 7A-7C illustrate various views of an assembled kinetic device including a strip connected to a headband, according to an exemplary embodiment of the present invention.
Figure 7B:
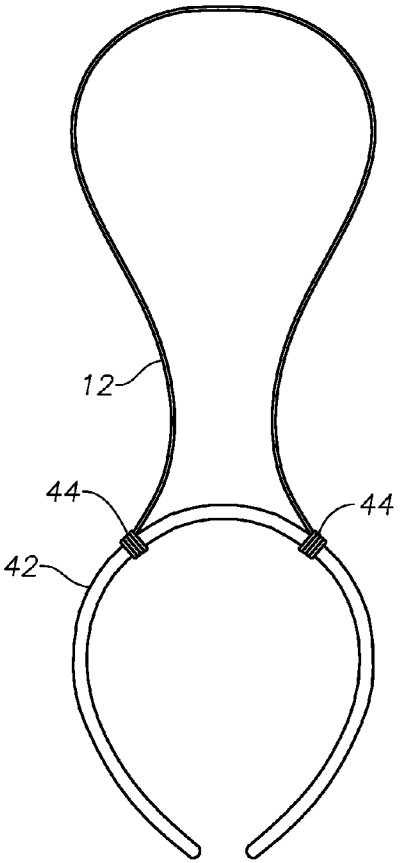
Figure 7A:
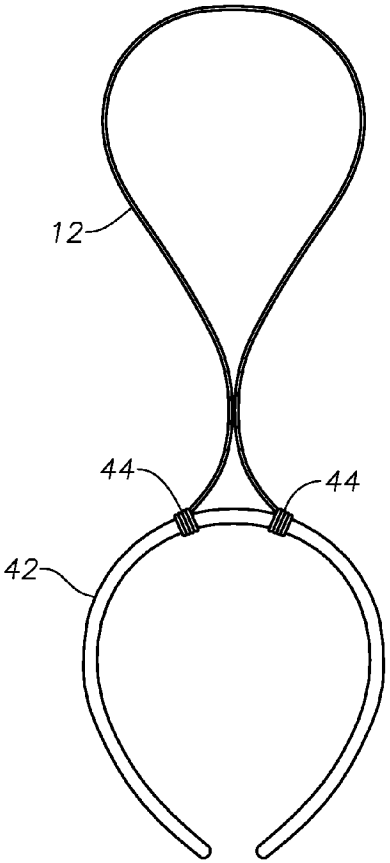

In other exemplary embodiments, any of the bases described herein may be various articles of clothing, such as, for example, a headband, helmet, hat, jacket, belt or other forms of clothing. FIG. 7A illustrates one such embodiment whereby one or more strips 12 may be attached to a headband 42. Strip 12 may be permanently or temporarily affixed to various points along a headband 42 via coupler 44 which may be, for example, elastic bands, clips, o-rings, snaps, brads, Velcro, or other fasteners and capable of being affixed in different, preplanned, or random, mixed positions. As shown in FIGS. 7B and 7C, the distance between coupler 44 may be manipulated to affect the static and kinetic shape of strip 12 as described herein. In yet another alternative embodiment, strip 12 may be attached to the hair directly, as opposed to headband 42.

Figure 8C:
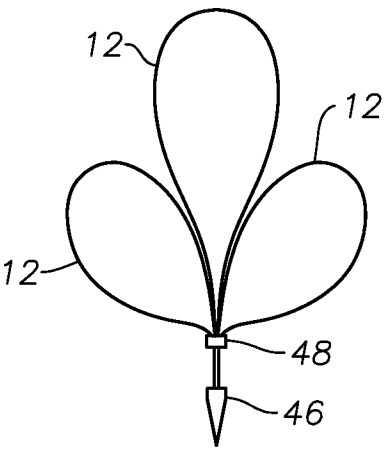
FIGS. 8A-8C illustrate another exemplary embodiment of the present invention whereby a plurality of strips have been formed into a flower bouquet arrangement.
Figure 8B:
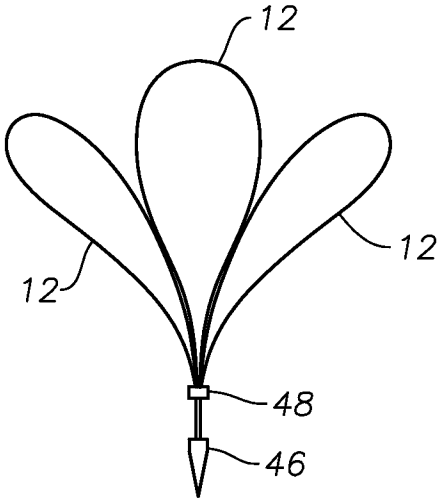
Figure 8A:
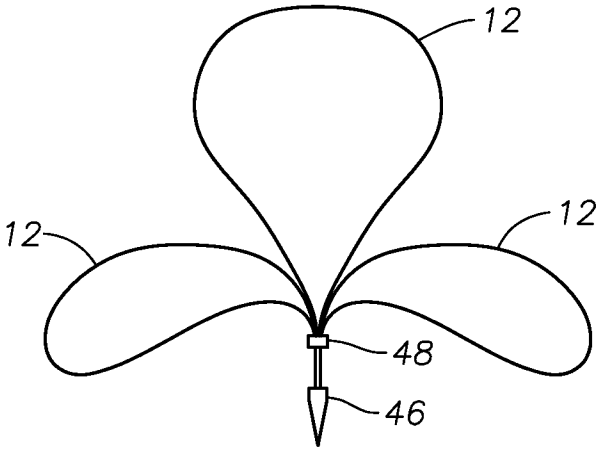

FIGS. 8A-8C illustrate another exemplary embodiment of the present invention whereby a plurality of strips 12 have been formed into a flower bouquet arrangement. One or more strips 12 are affixed with both ends in a single base 46. In this example, base 46 is a spike; however, it may also be a handle, handle held base, table top, floor base, or any of the other bases described herein. Strips 12 may be twisted in upon themselves to reveal various unique positions. One of the ends of one of the strips 12 may be affixed to base 46 with one of its ends at a half twist relative to the other end (180 degree, for example) before embedding it or affixing it to base 46. As a result of the half twist, certain embodiments result in the two outer strips 12 being torqued towards a downward position (FIG. 8A), an upward position (FIG. 8B) or a cloverleaf position (FIG. 8C). A coupler 48 positioned around the strips 12 in order to pinch up or shorten the length of the strip shapes. Coupler 48 may be positioned around strip 12 such that it slides along strip 12 to alter the static and kinetic shape. Coupler 48 may be, for example, elastic bands, clips, o-rings, snaps, brads, Velcro, etc. and is adjusted up or down in order to affect the changes in the shapes.

In one exemplary embodiment of the flower bouquet arrangement, the outer strips may be in parallel opposed to the center angle at 180 degrees attachment relative to each other. Further, three outer petals (strips 12) may have 120 degree angles relative to each other or attached in a triangular shape at base 46 and four outer petals may have 90 degree angle relative to each other attached in a square shape at base 46. Moreover, by using 360 degrees divided by the number of strips 12 utilized in any given embodiment, six outer strips would have 60 degree opposing angles.

Figure 9A:
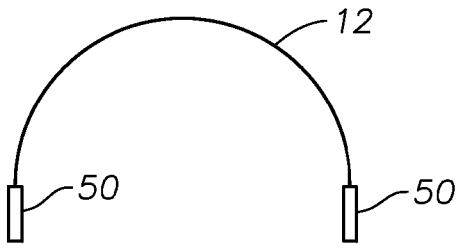
FIGS. 9A-9E illustrate another exemplary embodiment of the present invention whereby interlocking handles are utilized as the bases.

FIGS. 9A-9E illustrate yet another exemplary embodiment of the present invention whereby interlocking handles 50 are utilized as the bases. In FIG. 9A, two interlocking handles 50 have been affixed to a strip 12. Interlocking handles 50 may be placed in a user's hand whereby various kinetic and static shapes can be affected through movement of the wrist, hands, arms, etc. Oval shapes made by strips 12 can be widened and heightened depending on the width of the user's arms and whether they are holding handles 50 side by side or above each other. The static and kinetic shapes can be horizontal if handles 50 are rotated on their axes to be parallel to the floor, either in front behind or around the user.

Figure 9B:
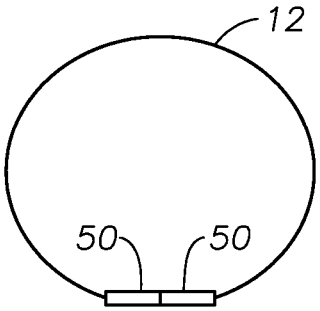
Figure 9C:
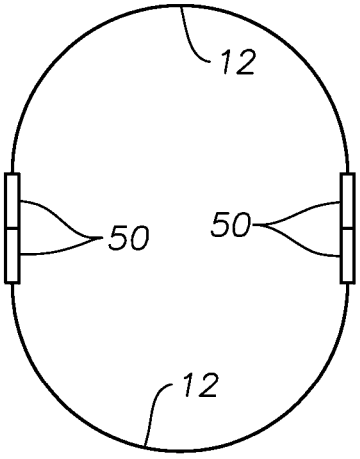
Figure 9D:
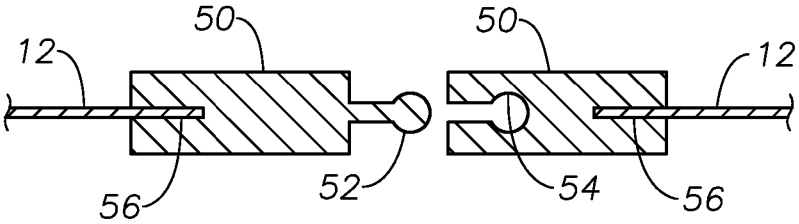
Figure 9E:
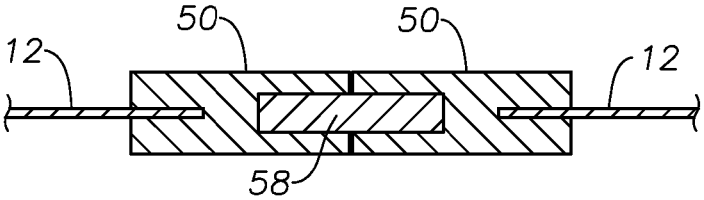

FIG. 9B shows the interlocking of the two handles 50. Alternatively, two sets (or more) of interlocking handles 50 and strips 12 may be utilized to form larger kinetic and static shapes (FIG. 9C). FIG. 9D illustrates one exemplary embodiment of the interlocking handles 50. To couple handles 50 together, a variety of locking mechanisms may be utilized. Here, one handle 50 is the male handle having an oval shaped end 52, while the other handle 50 servers as the female handle having a mating grove 54. Handles 50 may be made of a variety of materials, such as, for example, plastic. Strips 12 may be inserted into handles 50 along slots 56 using any suitable methodology. For example, male handle 50 may simply be inserted into mating grove 54. Once snapped into place, the two handles 50 are interlocked. Alternatively, a connector strip or rotatable pin may be used in place of oval shaped end 52 and mating groove 54, as illustrated in FIG. 9E.

Various other exemplary embodiments and applications of the present invention will now be described. An exemplary embodiment of the present invention may provide an entertainment device comprising of at least one flat strip or sheet of flexible springy material, affixed on each end, at similar or differing and various angles of entry, and attached relative to and into at least one base. In the alternative, a handle or other anchoring device (i.e., base) may be utilized, such as a polyhedron, spike, or complex mechanism. Once the strip(s) has been anchored, the anchoring devices (i.e., base) are oriented together or apart, and/or positioned on various similar or differing angles or axes in space, and/or resting on at least one, the same, or differing destination surface(s), in order to effect various static and kinetic shapes. As a result, the strip(s) are manipulated and positioned into varying degrees of tension, balance and stasis, or in relaxation, torque and/or twisted spring like configurations, creating therewith, a virtually unlimited variety of unique, simple, complex, or contorted shapes, arcs and models, each having either a rebounding, resonating or wobbling kinetic nature, or a semi or absolute motionless static nature, the intermediate or end result is for the purpose of either temporary contemplation, revision and exploration, or permanent placement and viewing enjoyment.

In yet another exemplary embodiment of the present invention, the kinetic device includes a plurality of strips or sheets, and a plurality of bases. As a result, a variety of separate or interconnected strip shapes can be created, as embodied in a game kit for creating a play-scape of various shapes. The strips may be permanently or temporarily affixed into differing faces of the base or polyhedrons or simply have their own spikes, or be embedded into differing locations on a board accepting many strips at once.

In another exemplary embodiment of the present invention, a kinetic device comprises only one flat strip having first and second ends that are affixed to only one base in close proximity with the strip. The strips are connected to the base in a predetermined angle of entry such that the strip is permanently formed in only one static or kinetic shape, such as a balloon, or circle, or ball, or loop. When the base is either inserted into the ground or a flower pot (when embodied as a spike), or when the strip is utilized as its own standalone weighted object, placed on a table, or a flat surface, all either permanently or temporary, the kinetic shape moves back and forth with the wind, water flow or is excited by the user's own hand or otherwise manipulated by other man made interventional means. In yet another exemplary embodiment, the ends of the strip are held together by welding, screws, glue, etc.

Another exemplary embodiment of the present invention provides a kinetic entertainment device that includes one or a plurality of strips, either in parallel or at other angles in relation to other strips, laying mostly flat on a level plinth or base surface. Each strip has each of its ends affixed to one or more bases, and each base being positioned in a singular or a variety of distances from each other, but closer to each other than the actual length of the strip. As a result, because there is more material length of strip between the base, the extra portion or length of the strip between the bases naturally suspend itself in a bell curve shape up above the base.

Furthermore, the bases may be adjusted from time to time or permanently positioned to create various heights of bell curves using the flat strip material, and leaving some length of flat strip material to lie flat on the plinth base on either side of the bell curve. Thus, the bell curve developed by the strip will be able to move back and forth in varying amounts of play, towards or away from each base, with the strip being excited by the wind, a user's hand, or any other wind power or magnetic or mechanical device.

In addition, movement of the strip may be affected through absorption of energy exerted on the strip from various directions. Since there is little resistance due to the highly balanced state of the strip's static curvature, movement depends on the direction of the force applied to the strip. As a result, in one exemplary embodiment, the leading tail of the strip's curve will pull up excess flat material and the curve's trailing tail will relax flat on the base.

In yet another exemplary embodiment, a kinetic entertainment device may comprise one or a plurality of strips in parallel or at other angles in relation to other strips. The strips may lay mostly flat on a plinth or base surface, and each strip has each of their ends embedded into one or more bases, and each base being positioned a variety of distances closer to each other than the actual length of the strip. As a result, the strips form a loop, then continues on in the same general parallel direction, with the loop being free to roll back and forth towards or away from each anchoring device when the strip has been excited by the wind, the user's hand, or any other wind power or magnetic or mechanical device.

In addition, the exemplary kinetic devices disclosed herein may be customized in a variety of forms, shapes, sizes, or material configurations as desired. Such varieties include, for example, miniature sizes intended for handheld portable use, desktop or table size intended for semi-portable or semi-permanent use, room size intended for semi-permanent use, or monumental size, intended for outdoor permanent installation. Moreover, the exemplary kinetic devices may be embodied as lawn games, walk through arcs, architectural structures, etc.

Moreover, the bases described herein may also accept strips into multiple sides, and/or may be positioned on varying surfaces (e.g., one on wall and one on ground, one on water and one on ground, etc.). In another embodiment, a landscape of chained together kinetic device forms may be created similar to an erector set, but instead having twisted moving strips. In the alternative, one strip may be provided with its ends meeting in parallel and sticking directly into the ground or other surface, thus creating a loop or exclamation mark. Moreover, such a shape would emulate a flower embedded into the ground, or a flower pot, containing dirt or other solid material.

Accordingly, upon excitation, various embodiments of the kinetic device described herein may move in a variety of exciting and entertaining patterns. Such patterns may include, for example, a suspended, hanging, hovering, moving, wobbling, undulating, rolling, waving, bridging, bouncing, reciprocating, repeating, sagging, drooping, rocking, twisting, coiling, or springing pattern.

Moreover, in other alternative exemplary embodiments of the present invention, strips 12 may comprise a variety of characteristics. For example, such characteristics may be various colors or materials comprised of phosphorescent material, light emitting material (e.g., light emitting diodes, etc.) reflective material, etc. Moreover, bases described herein may comprise wall mount kits that include holes to hang on screws or ball joints. Vibration kits, magnetic kits, or other mechanical units, may be coupled to the bases to excite the strips into movement automatically. Wall plug units, battery packs, solar power, etc. may be utilized to provide the necessary power for the mechanical units.

As previously mentioned, the strips described herein are sufficiently thin to take advantage of the selected material's combination of modulus of elasticity, tensile strength, stiffness and, hence, its springiness. It will be appreciated that in order to take advantage of the kinetic properties of a material as described herein, the geometry of strip 12 and material type, based on the mechanical properties of the material, must be properly selected. Thus, different materials may have different geometries, i.e., width, length and thickness. It is the relationship of these geometries, for any particular material, that results in the kinetic responses described herein. The most preferable materials for forming strip 12 are polymers, such as polycarbonate, or metal, such as spring tempered steel, although other materials with similar mechanical properties may also be utilized.

In certain exemplary embodiments, for polymers, it is desirable to form strip 12 to have a thickness to length ratio of approximately 1:1000-2500. Likewise, it is desirable to have a width to length ratio of 1:15-75. It the strip is too long relative to the thickness, the strip will not have enough rigidity to remain upright, while if the strip is too short relative to thickness, it will not have sufficient spring energy to function respond as described herein. In certain other exemplary embodiments, for metal, it is desirable to form strip 12 to have a thickness to length ratio of approximately 1:5500-8900. Likewise, it is desirable to have a width to length ratio of 1:25-80. In yet another exemplary embodiment, when a single strip is utilized with two bases, a polycarbonate strip may have approximate 0.02" thickness, approximate width between 0.5-1" and an approximate length between 36-46" from its exit points on each base. In another example, the strip may be approximately 0.04" thick, have a width of approximately between 1-1.5", and an approximate length between 50-65" from the exit points on each base. In another example, as the thickness and width of the strip doubles, the length may only increase by between 38-42%.

In yet another embodiment, the strip may be comprised of spring tempered steel of between 70-95% carbon content. In such an embodiment, the strip may be 0.004" in thickness, 0.5-0.8" in width, and 33-35" from the base exit points. Alternatively, the strip may be 0.008" in thickness, 1-1.6" in width, and 46-52" from the base exit points. Ultimately, the strip will be long enough to provide sufficient fluid motion and maximum suspension, while also short enough to hold certain static shapes that are maintained between the bases (if two bases are utilized). In those embodiments forming a flower bouquet arrangement (FIGS. 8A-8C), strips 12 may be short enough that when affixed at a 90 angle to its base, it is in a balanced static position when left alone, but still long enough that it can move freely from side to side with little force.

In those embodiments in which ferrous material is utilized in strip 12, the ferrous material may comprise a tensile strength of 200,000 psi minimum, a Rockwell hardness (C scale) of 48-51 minimum, and/or a carbon content of between 0.66 and 1.10%. In those embodiments utilizing polymers as the strip material, strip 12 may comprise the following characteristics: Tensile Stress, yld, Type I, 2.0 in/min—4,000-11,000 psi; Tensile Stress, brk, Type I, 2.0 in/min—8,000-12,000 psi; Tensile Strain, yld, Type I, 2.0 in/min—5-7%; Tensile Strain, brk, Type I, 2.0 in/min—>100%; and Tensile Modulus, 0.2 in/min—300,000-400,000 psi. However, those ordinarily skilled in the art having the benefit of this disclosure realize a large variety of materials may be utilized and the forgoing are provided as preferable materials and mechanical properties for certain embodiments.

An exemplary embodiment of the present invention provides a kinetic entertainment device, comprising a strip of flat, elongated, flexible material having a first and second end, the strip being adapted to be manipulated into one or more static configurations, the one or more static configurations each having a corresponding kinetic shape once excited into movement; a first base positioned at the first end of the strip; and a second base positioned at the second end of the strip, a distance between the first and second ends of the strip being less than a length of the strip, wherein the kinetic shape of the strip is maintained during excitation of the strip. In an alternative embodiment, the first and second bases are a single base. In another, the kinetic shape is at least one of a rebounding, resonating, or wobbling kinetic shape. In yet another, the first end of the strip is connected to the first base at a first specified angle, and the second end of the strip is connected to the second base at a second specified angle, thus resulting in the static configuration and the corresponding kinetic shape.

In another embodiment, the static configuration and the corresponding kinetic shape are one of a balloon, circle or loop shape. In yet another, the first and second bases are magnetic. In another, the device further comprises light emitting material positioned along the strip. In yet another, the first and second ends of the strip are spikes, the spikes thereby forming the first and second bases of the strip. In another, the device further comprises a second strip of flat, elongated, flexible material, the second strip comprising a first end connected to the first base and a second end connected to the second base. In yet another, the device further comprises a mechanism that excites the strip.

An exemplary methodology of the present invention provides a method for manufacturing a kinetic entertainment device, the method comprising providing a strip of flat, elongated, flexible material having a first and second end, the strip being adapted to be manipulated into one or more static configurations, the one or more static configurations each having a corresponding kinetic shape once excited into movement; providing a first base positioned at the first end of the strip; and providing a second base positioned at the second end of the strip, a distance between the first and second ends of the strip being less than a length of the strip, wherein the kinetic shape of the strip is maintained during excitation of the strip. In another method, the first and second bases are a single base. In yet another, the kinetic shape is at least one of a rebounding, resonating, or wobbling kinetic shape.

In another method, the first end of the strip is connected to the first base at a first specified angle, and the second end of the strip is connected to the second base at a second specified angle, thus resulting in the static configuration and the corresponding kinetic shape. In yet another, the static configuration and the corresponding kinetic shape are one of a balloon, circle or loop shape. In another method, the first and second bases are magnetic. In yet another, providing the strip further comprises providing light emitting material along the strip. In another, the first and second ends of the strip are spikes, the spikes thereby forming the first and second bases of the strip. In yet another, the method further comprises providing a second strip of flat, elongated, flexible material, the second strip comprising a first end connected to the first base; and a second end connected to the second base. In another, the method further comprises a mechanism that excites the strip.

An exemplary embodiment of the present invention provides a kinetic kit, comprising a strip of flat, elongated, flexible material adapted to be manipulated into one or more static configurations, whereby upon assembly the one or more static configurations each has a corresponding kinetic shape that is formed once the strip is excited into movement, the kinetic shape having an axis, and an elongated base adapted to be coupled to a plurality of points along the strip after the static configuration has been formed, the elongated base extending along an axis parallel to the axis of the kinetic shape, wherein the kinetic shape of strip is maintained during excitation of the strip. In another embodiment, the kinetic shape is at least one of a rebounding, resonating, or wobbling kinetic shape. In yet another, the static configuration and the corresponding kinetic shape are one of a balloon, circle or loop shape. In another, the kit further comprises light emitting material along the strip. In yet another, the kit further comprises the excitation mechanism to excite the strip.

Another exemplary embodiment of the present invention provides a kinetic kit, comprising a strip of flat, elongated, flexible material having a first and second end, the strip being adapted to be manipulated into one or more static configurations, whereby upon assembly the one or more static configurations each has a corresponding kinetic shape once excited into movement, a first base adapted to be connected at the first end of the strip, and a second base adapted to be positioned at the second end of the strip, whereby upon assembly a distance between the first and second bases being less than a length of the strip, wherein the kinetic shape of the strip is maintained during excitation of the strip. In another embodiment, the kinetic shape is at least one of a rebounding, resonating, or wobbling kinetic shape. In yet another, the first end of the strip is adapted to be connected to the first base at a first specified angle, and the second end of the strip is adapted to be connected to the second base at a second specified angle, thus resulting in the static configuration and the corresponding kinetic shape. In another, the static configuration and the corresponding kinetic shape are one of a balloon, circle or loop shape.

In yet another, the first and second bases are magnetic. In another embodiment, the kit further comprises light emitting material along the strip. In yet another, the kit further comprises a second strip of flat, elongated, flexible material, the second strip comprising a first end adapted to be connected to the first base and a second end adapted to be connected to the second base. In another, the kit further comprises a mechanism to excite the strip. Furthermore, the kit further comprises instructions for assembling the kit into an entertainment device as described herein.

An exemplary methodology of the present invention provides a method for manufacturing a kinetic kit, the method comprising providing a strip of flat, elongated, flexible material adapted to be manipulated into one or more static configurations, whereby upon assembly the one or more static configurations each has a corresponding kinetic shape that is formed once the strip is excited into movement, the kinetic shape having an axis; and providing an elongated base adapted to be coupled to a plurality of points along the strip after the static configuration has been formed, the elongated base extending along an axis parallel to the axis of the kinetic shape, wherein the kinetic shape of strip is maintained during excitation of the strip. In an alternative method, the kinetic shape is at least one of a rebounding, resonating, or wobbling kinetic shape. In yet another, the static configuration and the corresponding kinetic shape are one of a balloon, circle or loop shape. In another, providing the strip further comprises providing light emitting material along the strip. In yet another, the method further comprises providing an excitation mechanism that excites the strip into movement.

Yet another exemplary method of the present invention provides a method for manufacturing a kinetic kit, the method comprising providing a strip of flat, elongated, flexible material having a first and second end, the strip being adapted to be manipulated into one or more static configurations, whereby upon assembly the one or more static configurations each has a corresponding kinetic shape once excited into movement; providing a first base adapted to be connected at the first end of the strip; and providing a second base adapted to be positioned at the second end of the strip, whereby upon assembly a distance between the first and second bases being less than a length of the strip, wherein the kinetic shape of the strip is maintained during excitation of the strip. In an alternative method, the kinetic shape is at least one of a rebounding, resonating, or wobbling kinetic shape. In another, the first end of the strip is adapted to be connected to the first base at a first specified angle, and the second end of the strip is adapted to be connected to the second base at a second specified angle, thus resulting in the static configuration and the corresponding kinetic shape.

In yet another, the static configuration and the corresponding kinetic shape are one of a balloon, circle or loop shape. In another, the first and second bases are magnetic. In yet another, providing the strip further comprises providing light emitting material along the strip. In another, the method further comprises providing a second strip of flat, elongated, flexible material, the second strip comprising a first end adapted to be connected to the first base; and a second end adapted to be connected to the second base. In another, the method further comprises providing a mechanism to excite the strip.

Yet another exemplary embodiment of the present invention provides a kinetic entertainment device, comprising a strip of flat, elongated, flexible material having a first and second end characterized by a width, thickness and length, the strip being adapted to be manipulated into one or more static configurations, the one or more static configurations each having a corresponding kinetic shape once excited into movement; a first base positioned at the first end of the strip; and a second base positioned at the second end of the strip, a distance between the first and second ends of the strip being less than a length of the strip, wherein the strip comprises a first static portion at the first base, a second static portion at the second base, and a dynamic portion therebetween.

An exemplary methodology of the present invention provides a method for manufacturing a kinetic entertainment device, the method comprising providing a strip of flat, elongated, flexible material having a first and second end, the strip being adapted to be manipulated into one or more static configurations, the one or more static configurations each having a corresponding kinetic shape once excited into movement; providing a first base positioned at the first end of the strip; and providing a second base positioned at the second end of the strip, a distance between the first and second ends of the strip being less than a length of the strip, wherein the kinetic shape of the strip is maintained during excitation of the strip, and wherein the strip comprises a first static portion at the first base, a second static portion at the second base, and a dynamic portion therebetween.

Although various embodiments and methodologies have been shown and described, the invention is not limited to such embodiments and methodologies and will be understood to include all modifications and variations as would be apparent to one skilled in the art. Therefore, it should be understood that the invention is not intended to be limited to the particular forms disclosed. Rather, the intention is to cover all modifications, equivalents and alternatives falling within the spirit and scope of the invention as defined by the appended claims.

The invention claimed is:

1. A kinetic entertainment device, comprising:

a strip of flat, elongated, flexible material having a first and second end, the strip characterized by a width, thickness and length, the strip being adapted to be manipulated into one or more static configurations, the one or more static configurations each having a corresponding kinetic shape once the strip is excited into movement;

a first fixed base positioned at the first end of the strip; and a second fixed base positioned at the second end of the strip to define a fixed distance between the bases, a distance between the first and second ends of the strip being less than a length of the strip, wherein the strip comprises a first static portion at the first base, a second static portion at the second base, and a dynamic portion therebetween, the dynamic portion of the capable of being excited into movement while maintaining the fixed distance between the bases.

2. A kinetic entertainment device, comprising:

a strip of flat, elongated, flexible material having a first and second end characterized by a width, thickness and length, the strip being adapted to be manipulated into one or more static configurations, the one or more static configurations each having a corresponding kinetic shape once excited into movement; and a single base having a first attachment point to which the first end of the strip is secured, a second attachment point to which the second end of the strip is secured, with a distance between the first and second ends of the strip as secured at the attachment points being less than a length of the strip, wherein the strip comprises a first static portion at the first base, a second static portion at the second base, and a dynamic portion therebetween.

3. A device as defined in claims 1 or 2, wherein the strip is formed of a polymer and is characterized by a thickness to length ratio of 1:1000-2500.

4. A device as defined in claims 1 or 2, wherein the strip is formed of steel and is characterized by a thickness to length ratio of 1:5500-8900.

5. A device as defined in claim 1, wherein the first and second bases are spaced apart from one another a linear distance less than the length of the strip.

6. A device as defined in claim 1, wherein the first and second bases comprise cubes, each cube having six faces.

7. A device as defined in claims 1 or 2, further comprising light transmitting or emitting material positioned along the strip.

8. A device as defined in claim 1, wherein each base comprises at least two faces with at least one one attachment point for the strip disposed on each face.

9. A device as defined in claims 1 or 2, wherein the strip comprises a light transmitting material and one of the bases comprises a light source.

10. A device as defined in claim 1, further comprising a second strip of flat, elongated, flexible material, the second strip comprising:

a first end connected to the first base; and a second end connected to the second base.

11. A device as defined in claims 1 or 2, further comprising a strip excitation mechanism.

12. A device as defined in claim 1, wherein the first and second bases are interlocking handles.

13. A device as defined in claim 1, wherein the first and second bases comprise clothing.

14. A device as defined in claim 13, wherein the clothing is a headband.

15. A device as defined in claim 13, wherein the clothing is a hat or helmet.

16. A device as defined in claims 1 or 2, further comprising a coupler positioned around the strip, the coupler adapted to slide along the strip to alter the dynamic portion of the strip.

17. A device as defined in claim 1, wherein at least one of the bases has a plurality of attachment points for attaching one or more strips.

18. A device as defined in claims 17 or 2, wherein the attachment points comprise slots defined in the base.

19. A device as defined in claims 17 or 2, wherein the base comprises at least two faces with an attachment point on each face.

20. A device as defined in claim 18, wherein the slots are angled relative to a face of the base on which the slots are disposed.

21. A device as defined in claim 1, wherein each base comprises at least two faces with at least two attachment points for the strip disposed on each face.

22. A device as defined in claim 21, wherein each base is a cube.

23. A device as defined in claim 22, wherein the base is formed of rubber.

24. A device as defined in claim 2, wherein the first and second attachment points on the base are spaced apart from one another a linear distance less than the length of the strip.

25. A device as defined in claim 2, wherein the base comprises at least two faces with at least two attachment points for the strip disposed on the base.

26. A device as defined in claim 2, wherein the base comprise a cube.

27. A device as defined in claim 2, further comprising a second strip of flat, elongated, flexible material, the second strip comprising:

a first end connected to the an attachment point on the base; and a second end connected to an attachment point on the base.

28. A device as defined in claim 2, wherein the base comprises at least two faces with at least two attachment points for the strip disposed on each face.

29. A device as defined in claim 2, wherein the base has a plurality of separate, spaced apart attachment points for attaching one or more strips.

30. A device as defined in claim 2, further comprising a plurality of strips, each strip formed of flat, elongated, flexible material and having a first end connected to the an attachment point on the base; and a second end connected to an attachment point on the base.

31. A device as defined in claim 2, wherein the base is a headband.

32. A device as defined in claim 2, wherein the base is a hat or helmet.

33. A device as defined in claim 2, wherein the base comprise clothing.

34. A device as defined in claim 1, wherein each base is a spike.

35. A device as defined in claim 2, wherein the base is a spike.

36. A device as defined in claim 35, further comprising a second strip of flat, elongated, flexible material, the second strip comprising:

a first end connected to the an attachment point on the base; and a second end connected to an attachment point on the base.

37. A device as defined in claims 2 or 36, further comprising a plurality of second strips, each formed of flat, elongated, flexible material, each second strip comprising:

a first end connected to the an attachment point on the base; and a second end connected to an attachment point on the base.

38. A device as defined in claim 1, further comprising a plurality of second strips, each formed of flat, elongated, flexible material, each second strip comprising:

a first end connected to the an attachment point on the first base; and a second end connected to an attachment point on the second base.

39. A method for manufacturing a kinetic entertainment device, the method comprising:

providing a strip of flat, elongated, flexible material having a first and second end, the strip characterized by a width, thickness and length, the strip being adapted to be manipulated into one or more static configurations, the one or more static configurations each having a corresponding kinetic shape once the strip is excited into movement;

providing a first fixed base positioned at the first end of the strip;

providing a second fixed base positioned at the second end of the strip to define a fixed distance between the bases, a distance between the first and second ends of the strip being less than a length of the strip, wherein the kinetic shape of the strip is maintained during excitation of the strip, and wherein the strip comprises a first static portion at the first base, a second static portion at the second base, and a dynamic portion therebetween; and exciting the dynamic portion of the strip into movement while maintaining the fixed distance between the bases.

40. A method for manufacturing a kinetic entertainment device, the method comprising:

providing a strip of flat, elongated, flexible material having a first and second end, the strip being adapted to be manipulated into one or more static configurations, the one or more static configurations each having a corresponding kinetic shape once excited into movement;

providing a single base having a first attachment point to which the first end of the strip is secured, a second attachment point to which the second end of the strip is secured, with a distance between the first and second ends of the strip as secured at the attachment points being less than a length of the strip, wherein the kinetic shape of the strip is maintained during excitation of the strip, and wherein the strip comprises a first static portion at the first base, a second static portion at the second base, and a dynamic portion therebetween.

41. A method as defined in claims 39 or 40, wherein the strip is formed of a polymer and is characterized by a thickness to length ratio of 1:1000-2500.

42. A method as defined in claims 39 or 40, wherein the strip is formed of steel and is characterized by a thickness to length ratio of 1:5500-8900.

43. A method as defined in claim 39, wherein the first and second bases are spaced apart from one another a linear distance less than the length of the strip.

44. A method as defined in claim 39, wherein the first and second bases comprise rubber cubes, each cube having six faces.

45. A method as defined in claim 44, wherein each cube comprises at least one attachment point for a strip on at least two faces.

46. A method as defined in claims 39 or 40, wherein the strip further comprises light transmitting or emitting material.

47. A method as defined in claim 39, wherein the strip comprises a light transmitting material and one of the bases comprises a light source.

48. A method as defined in claim 39, further comprising a second strip of flat, elongated, flexible material, the second strip comprising:

a first end connected to the first base; and a second end connected to the second base.

49. A method as defined in claims 39 or 40, further comprises exciting the strip using a strip excitation mechanism.

50. A method as defined in claim 39, wherein the first and second bases are interlocking handles.

51. A method as defined in claim 39, wherein the first and second bases comprise a headband.

52. A method as defined in claims 39 or 40, further comprising a coupler positioned around the strip, the coupler adapted to slide along the strip to alter the dynamic portion of the strip.

53. A method as defined in claim 39, wherein at least one of the bases has a plurality of attachment points for attaching one or more strips.

54. A method as defined in claims 53 or 40, wherein the attachment points comprise slots extending through the base.

55. A method as defined in claim 54, wherein the slots are angled relative to a face of the base on which the slots are disposed.

56. A method as defined in claims 53 or 40, wherein the base comprises at least two faces with an attachment point on each face.

57. A kinetic entertainment device, comprising:

a strip of flat, elongated, flexible material having a first and second end, the strip characterized by a width, thickness and length selected so as not to retain coil memory in the strip between the two ends, the strip being adapted to be manipulated into one or more static configurations, the one or more static configurations each having a corresponding kinetic shape once the strip is excited into movement;

a first base positioned at the first end of the strip; and a second base positioned at the second end of the strip to define a fixed distance between the bases, a distance between the first and second ends of the strip being less than a length of the strip, wherein the strip comprises a first static portion at the first base, a second static portion at the second base, and a dynamic portion therebetween.

58. A kinetic entertainment device, comprising:

a strip of flat, elongated, flexible material having a first and second end, the strip characterized by a width, thickness and length, the strip being adapted to be manipulated into one or more static configurations, the one or more static configurations each having a corresponding kinetic shape once the strip is excited into movement;

a first base positioned at the first end of the strip; and a second base positioned at the second end of the strip, a distance between the first and second ends of the strip being less than a length of the strip, wherein the strip comprises a first static portion at the first base, a second static portion at the second base, and a dynamic portion therebetween, wherein the strip is primarily bendable about the width of the strip.

* * * * *